United States Patent [19]

Milone

[11] 4,066,030

[45] Jan. 3, 1978

[54] MECHANICAL COUPLING FOR MARINE VEHICLES

[76] Inventor: Louis Milone, 531 Jefferson St., New Orleans, La. 70121

[21] Appl. No.: 662,973

[22] Filed: Mar. 1, 1976

[51] Int. Cl.[2] ..... B63B 21/00; B63B 21/56

[52] U.S. Cl. ..... 114/230; 114/250

[58] Field of Search ..... 114/235 R, 235 A, 230, 114/77 R, 249, 250

[56] References Cited

U.S. PATENT DOCUMENTS

| | | | |
|---|---|---|---|
| 1,458,134 | 6/1923 | Constan | 114/77 R |
| 2,798,448 | 7/1957 | Hale | 114/235 R |
| 2,871,813 | 2/1959 | Kiawitter | 114/230 |
| 2,873,712 | 2/1959 | Gossen | 114/230 |
| 2,990,803 | 7/1961 | Henderson | 114/230 |
| 3,035,536 | 5/1962 | Archer | 114/77 R |
| 3,060,885 | 10/1962 | Nolf | 114/230 |
| 3,142,284 | 7/1964 | Kauffman | 114/230 |
| 3,645,225 | 2/1972 | Lunde | 114/235 R |
| 3,660,856 | 5/1972 | Smulders | 9/8 P |
| 3,844,245 | 10/1974 | Yamaguchi | 114/235 R |
| 3,938,461 | 2/1976 | Marriner | 114/230 |

FOREIGN PATENT DOCUMENTS

| | | | |
|---|---|---|---|
| 125,694 | 6/1967 | Czechoslovakia | 114/235 R |
| 1,202,675 | 1/1962 | Germany | 114/235 R |

*Primary Examiner*—Trygve M. Blix
*Assistant Examiner*—Gregory W. O'Connor
*Attorney, Agent, or Firm*—Shlesinger, Arkwright, Garvey & Dinsmore

[57] ABSTRACT

This invention is a mechanical coupling for lashing marine vehicles together or to a dock. The coupling includes male and female members secured respectively to different vehicles or to a dock and a vehicle, which members may be quickly and easily connected and disconnected as desired. The female member includes a vertical track of substantial length in which the male member is movably positioned, thereby permitting relative vertical movement of the male member in the female member in order to compensate for the rise and fall of the vehicle in the water.

13 Claims, 8 Drawing Figures

Fig. 1
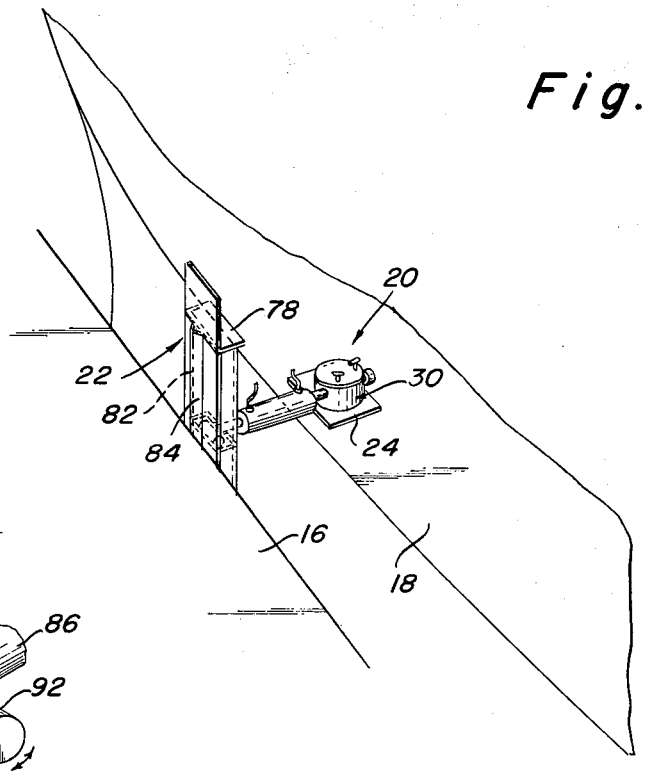
Fig. 8
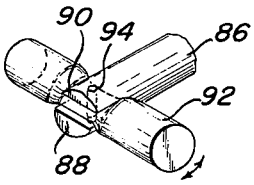
Fig. 2
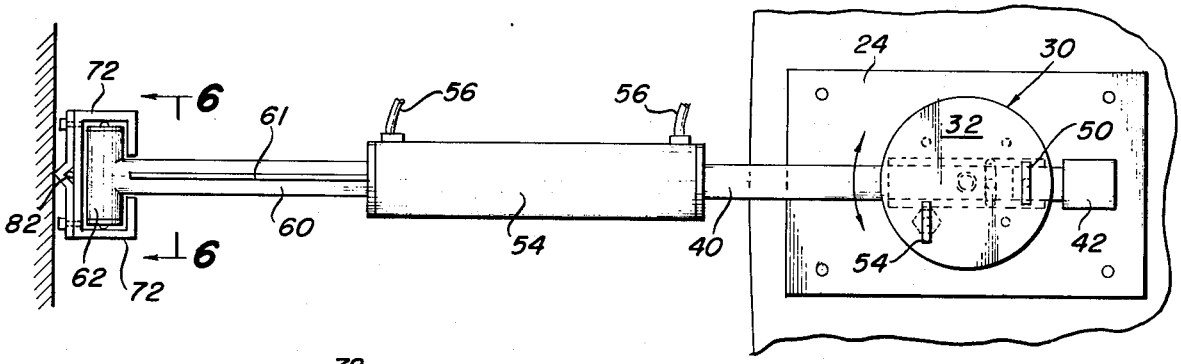
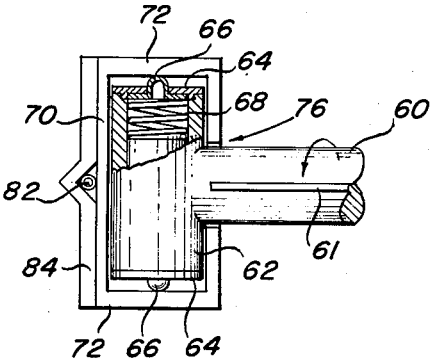
Fig. 3

Fig.4
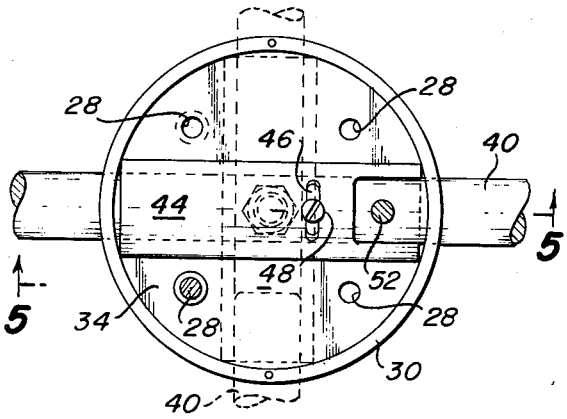
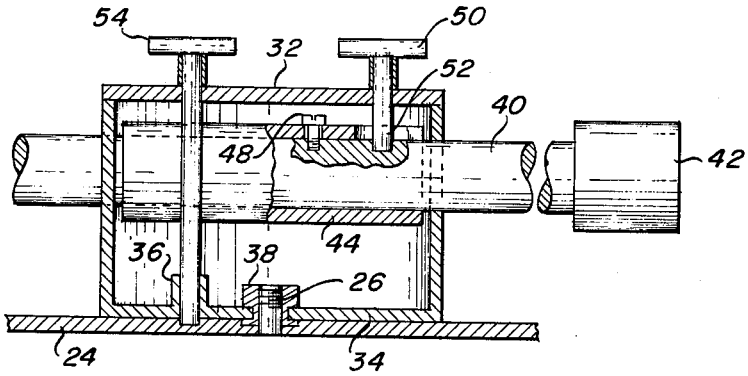
Fig.5
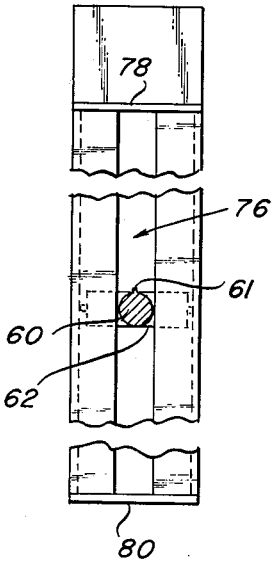
Fig.6
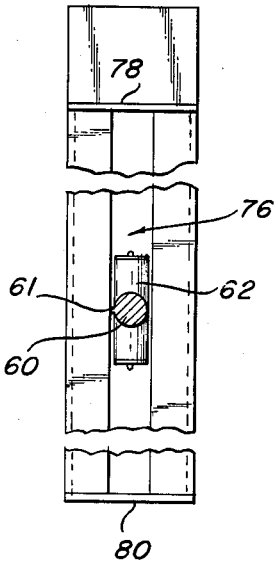
Fig.7

MECHANICAL COUPLING FOR MARINE VEHICLES

BACKGROUND OF THE INVENTION

In coupling barges together for transport, or in mooring barges, it has been standard practice to attach a wire cable to the barges to be connected, following which a ratchet or winch is employed to take up slack to tighten the cable between the barges. This leaves no provision for the barges to rise and fall individually in the water, thereby causing the cable to break, due to tremendous stress and strain thereon. This, in turn, results in runaway barges which create a serious hazard to other marine vehicles, human life and stationary structures such as bridges. Similar problems exist in the coupling and docking of other types of marine vehicles.

SUMMARY OF THE INVENTION

The present invention is a device for coupling marine vehicles to each other or to a dock, which device includes male and female members that are lockingly engaged with each other, but wherein relative vertical movement of the members is permitted, to compensate for the rise and fall of marine vehicles in the water.

The mechanical coupling includes a male member which is slideably positioned in a vertical track, means being provided for inserting the male member into the track and for maintaining the two members in operative position without danger of accidental disengagement thereof. The present coupling further contemplates means to allow limited play of the component parts thereof, and providing means for heating the track to prevent icing thereof in cold water.

DESCRIPTION OF FIGURES OF THE DRAWINGS

FIG. 1 is a perspective view of the mechanical coupling of the present invention, illustrating its application;

FIG. 2 is a top plan view of the present coupling;

FIG. 3 is an enlarged top plan view of a portion of the coupling, a portion thereof being broken away to disclose the details of construction;

FIG. 4 is an enlarged top plan view of the housing forming a part of the present invention;

FIG. 5 is a sectional view taken along the line 5—5 of FIG. 4, looking in the direction of the arrows;

FIG. 6 is a section view taken along the line 6—6 of FIG. 2, looking in the direction of the arrow, showing the coupling in operative position;

FIG. 7 is a view similar to FIG. 6, showing the coupling in inoperative position, and FIG. 8 is a perspective view of a modified form of the T-bar forming a part of the present invention.

DESCRIPTION OF THE INVENTION

In FIG. 1, there is shown a mechanical coupling for marine vehicles 16 and 18 which coupling comprises a male member designated 20 and a female member generally designated 22, the members being adapted to be quickly and positively interengaged with each other for connecting marine vehicles to each other or to a dock.

As shown to advantage in FIGS. 4 and 5, male member 22 includes a base plate 24 which is secured to the deck of a ship in any suitable manner. Base plate 24 is provided with a central upstanding threaded shaft 26 and a plurality of spaced apertures 28.

A circular housing 30 having a top wall 32 and a bottom wall 34 is superimposed on the base plate. For this purpose, a circular threaded boss 36 is mounted on bottom wall 34 and is adapted to receive threaded shaft 26 of base plate 24. A tubular boss 38 is mounted on bottom plate 34 adjacent boss 36 for a purpose which will be hereinafter more fully set out.

A circular elongated shaft 40 extends through and beyond circular wall 30, to one end of which shaft is affixed a control knob 42 for effecting rotational movement of shaft 40. In order to prevent longitudinal movement of shaft 40 in housing 30, there is provided a tubular sleeve 44 extending diametrically through housing 30, the terminals of the sleeve engaging the housing periphery. Sleeve 44 is provided with a peripheral slot 46 in which is positioned a set screw 48 which threads into a complemental recess in shaft 40, as shown in FIG. 5. This arrangement permits limited rotational movement of shaft 40 with respect to tubular sleeve 44.

A pin 50 extends through top plate 32 for engagement with a recess 52 on shaft 40 for locking shaft 40 in the operative position. A second pin 54 extends through top plate 32 and through circular boss 38 for selective engagement with aperture 28 and base plate 24. This permits shaft 40 to be oriented in different directions as shown in FIG. 4, while at the same time, locking the housing and base plate together. Beyond the housing, shaft 40 is connected to a standard hydraulic cylinder 54 having supply lines 56 and 58. A piston shaft 60 extends from cylinder 54, the shaft being provided with a spline 61, or other suitable conventional means for preventing relative rotational movement of shaft 60 with respect to cylinder 54. A cross member 62 is fixed to the outer end of shaft 60 thereby providing a T-shaped locking member.

As shown to advantage in FIG. 3, cross member 62 is provided with end walls 64, each of which has a central opening therein through which a part of a spring clip 66 protrudes, the spring clip being urged outwardly by a convolute spring 68, for purposes which will be hereinafter set out.

Female member 22 includes an elongated channel track which comprises a rear wall 70, side walls 72 and a front wall 74. Front wall 74 is provided with a longitudinal slot 76 which is coextensive therewith and a top wall 78 and bottom wall 80 serve as stop members to limit the movement of male member 20 within the track of the female member. In accordance with the present invention, there is provided a heater element 82 which is affixed to the outer face of rear wall 70 and is held in position by suitable means 84 in order to maintain the track free of ice in cold weather.

In FIG. 8, there is illustrated a modified form of T-bar wherein the shaft 86 thereof is split at the end to provide spaced furcations 88 and 90. A cross member for the T-bar is indicated at 92, the central portion of which is of reduced size to fit between furcations 88 and 90. A pin 94 extends through furcations 88 and 90 and cross member 92 to effect pivotal engagement of the cross member with shaft 86 and to permit limited movement of the cross member with respect to shaft 86. This permits a small amount of play when the male member is inserted through slot 76 of the female member.

OPERATION

In use of the coupling of the present invention, male member 20 is oriented in the direction of female member 22 by locating pin 54 in the desired aperture 28, following which pin 50 is disengaged from shaft 40 to permit actuation of knob 42 to rotate cross member 62 to the vertical or inoperative position. Cylinder 54 may then be actuated to urge member 62 through slot 76 of front wall 74 as shown in FIG. 7. Knob 42 is then rotated to correspondingly rotate cross member 62 to the horizontal position shown in FIG. 6, following which pin 50 is inserted into recess 52 to lock the cross member in operative position.

As shown in FIGS. 2 and 3, the outwardly urged spring clips 66 engage side walls 72 and serve to maintain the T-member centered in longitudinal slot 76. Top and bottom walls 78 and 80 limit the upward and downward movement of the T-member within the track of female member 22, yet allow for the free vertical movement of the T-member between the top and bottom walls caused by the relative vertical movement of the marine vehicles or the dock.

In order to disengage the male and female member, it is only necessary that pin 50 be removed from recess 52, following which control knob 42 is actuated to rotate shafts 40 and connected shaft 60 to move cross member 62 to the inoperative position of FIG. 7. Hydraulic cylinder 54 is then actuated to retract shaft 60 to withdraw cross member 62 from the female member.

The present invention affords simple but effective means for mechanically coupling marine vehicles with each other or with a dock, the coupling being operative to maintain the vehicles a fixed distance from each other or from a dock, yet allowing limited relative vertical movement of component parts of the coupling without relative lateral movement thereof. Female member 22 may be of any desired length, depending upon the differences in the rise and fall of the marine vehicle in the particular water in which it is placed.

While there has been herein shown and described the presently preferred form of this invention, it is to be understood that various changes may be made therein within the scope of the appended claims.

What is claimed is:

1. A mechanical coupling for marine vehicles including:

a. a female member comprising a housing having an enclosed, vertically disposed track,
b. a male member for connection to said female member and including a housing,
c. a shaft extending through said male member housing and having an angularly disposed portion at one end thereof,
d. means for rotating said shaft,
e. means for selectively engaging the angularly disposed portion of the shaft in said female member track,
f. means for locking said angularly disposed portion of said shaft in said female member while permitting relative vertical movement of male and female members,
g. a tubular member within said male member housing in sleeved engagement with said shaft,
h. the terminals of said tubular member being in substantial engagement with male member housing wall, and
i. a set screw extending through said tubular member into securing engagement with said shaft for preventing longitudinal movement of said shaft with respect to said male member housing.

2. The mechanical coupling of claim 1, wherein a. said male member includes a base plate on which said male member housing is swivelly mounted,
b. said base plate having a plurality of spaced apertures, and
c. a pin extending through said male member housing into selective engagement with the base plate aperture for orienting said male member housing and shaft.

3. A mechanical coupling for marine vehicles including:

a. a female member comprising a housing having an enclosed, vertically disposed track,
b. a male member for connection to said female member, and including an elongated shaft having a cross member attached to one end thereof,
c. said male member including a housing,
d. said elongated shaft extending through said housing,
e. means for rotating said shaft,
f. a pin extending through said male member housing,
g. said pin being selectively engaged with the periphery of said elongated shaft for preventing rotational movement thereof, and
h. means for preventing longitudinal movement of said shaft with respect to said housing.

4. The mechanical coupling of claim 3, wherein:

a. said male member includes a base plate on which said male member housing is swivelly mounted,
b. said base plate having a plurality of spaced apertures, and
c. a pin extending through said male member housing into selective engagement with the base plate aperture for orienting the male member housing and elongated shaft.

5. A mechanical coupling for marine vehicles including:

a. a female member comprising an elongated, vertically disposed, enclosed housing having a longitudinal slot in a portion thereof,
b. a male member for connection to said female member,
c. said male member including a housing,
d. an elongated shaft extending through and beyond said housing,
e. a cross member secured to one end of said elongated shaft and inserted through the longitudinal slot of said elongated housing when the cross member is aligned therewith, said cross member being rotated after insertion through the longitudinal slot of said female member housing to lock said second member in said first member.
f. a tubular member within the housing of said male member in sleeved engagement with said elongated shaft,
g. said tubular member being provided with a peripheral slot,
h. said elongated shaft having a recess aligned with the peripheral slot of said tubular member,
i. set screw means positioned in the peripheral slot of said tubular member and engaged with the recess of said elongated shaft for preventing longitudinal movement of said elongated shaft with respect to said male member housing, but permitting limited rotational movement of said elongated shaft with respect to said tubular member.

6. The mechanical coupling of claim 5, with the addition of:

a. a pin extending through said male member housing, b. said pin being selectively engaged with the periphery of said elongated shaft for preventing rotational movement thereof.

7. The mechanical coupling of claim 6, wherein:

a. said male member includes a base plate on which said male member housing is swivelly mounted, b. said base plate having a plurality of spaced apertures, and c. a pin extending through said housing into selective engagement with the base plate apertures for orienting the housing and elongated shaft.

8. The mechanical coupling of claim 7, with the addition of:

a. a control knob engaged with the end of said elongated shaft opposite said cross member.

9. The mechanical coupling of claim 7, with the addition of:

a. a heating element affixed to said female member housing for maintaining the latter free of ice.

10. The mechanical coupling of claim 7, with the addition of:

a. spring clips attached to the terminals of the cross member of said male member, and b. spring means for urging said spring clips outwardly into engagement with the elongated, vertically disposed, enclosed housing of said female member.

11. The mechanical coupling of claim 7, with the addition of:

a. hydraulic means for extending the elongated shaft of said male member into engagement with the housing of said female member.

12. A mechanical coupling for marine vehicles including:

a. a first member having a vertically disposed track member, b. a second member having an elongated shaft including a locking portion at one end thereof for engagement with said vertically disposed track member, c. means for rotating said elongated shaft for selectively engaging said locking portion thereof with, and disengaging the same from, the vertically disposed track member, d. said second member including a housing through which said elongated shaft extends, e. means on said housing engageable with the periphery of said elongated shaft for selectively locking said elongated shaft to prevent rotational movement thereof, f. a retaining member within said housing in sleeved engagement with said elongated shaft, and g. locking means extending through said retaining member into securing engagement with said shaft for preventing longitudinal movement of said elongated shaft with respect to said housing.

13. A mechanical coupling for marine vehicles including:

a. a first member having a vertically disposed track member, b. said first member including an elongated vertically disposed housing having a longitudinal slot in one portion thereof, c. a second member having an elongated shaft including a locking portion at one end thereof for engagement with said vertically disposed track member, d. the locking portion of said second member including a cross member inserted through the longitudinal slot of said elongated housing when the cross member is aligned therewith, said cross member being rotated after insertion through the longitudinal slot of said elongated housing to lock said second member in said first member.

e. clip means attached to the terminals of the cross member of said second member, f. spring means for urging said clip means outwardly into engagement with said elongated, vertically disposed housing, g. means for rotating said elongated shaft for selectively engaging said locking portion thereof with, and disengaging the same from, the vertically disposed track member, h. said second member including a housing through which said elongated shaft extends, i. means on said housing engageable with the periphery of said elongated shaft for selectively locking said elongated shaft to prevent rotation of movement thereof, and j. means on said housing engageable with said elongated shaft for preventing longitudinal movement of said elongated shaft with respect to said housing.

* * * * *